US011859945B1

(12) United States Patent
Kim et al.

(10) Patent No.: US 11,859,945 B1
(45) Date of Patent: Jan. 2, 2024

(54) HANDGUN EQUIPPED WITH ADAPTER PLATE AND SLIDE FOR MOUNTING DOT-SIGHT WITH IMPROVED ASSEMBLY STRUCTURE

(71) Applicant: DASAN MACHINERIES CO., LTD, Jeollabuk-do (KR)

(72) Inventors: Byung Gun Kim, Jeollabuk-do (KR); Jong Bum Kim, Jeonju-si (KR)

(73) Assignee: DASAN MACHINERIES CO., LTD, Jeollabuk-do (KR)

( * ) Notice: Subject to any disclaimer, the term of this patent is extended or adjusted under 35 U.S.C. 154(b) by 0 days.

(21) Appl. No.: 17/868,757

(22) Filed: Jul. 19, 2022

(51) Int. Cl.
*F41G 1/02* (2006.01)
*F41G 11/00* (2006.01)

(52) U.S. Cl.
CPC ..... *F41G 1/02* (2013.01); *F41G 11/003* (2013.01)

(58) Field of Classification Search
CPC ..... F41G 1/02; F41G 11/003
See application file for complete search history.

(56) References Cited

U.S. PATENT DOCUMENTS 2,545,419 A * 3/1951 Williams ..... F41G 11/006 248/316.1
4,494,328 A * 1/1985 Stevens ..... F41C 27/00 42/115
4,628,611 A * 12/1986 Ruffino ..... F41G 1/16 42/137
7,287,351 B1 10/2007 Warren
7,296,376 B2 * 11/2007 Kidd ..... F41G 1/02 89/41.17
7,730,655 B2 * 6/2010 Spuhr ..... F41G 11/006 42/127
7,811,024 B2 * 10/2010 Vendetti ..... F41G 11/003 403/381
8,127,485 B2 * 3/2012 Moore ..... F41G 11/003 42/117
9,568,282 B1 * 2/2017 Schorman ..... G03B 17/561
9,696,114 B1 * 7/2017 Cabrera ..... F41G 1/10
10,718,592 B1 * 7/2020 Wheeler ..... F41G 1/17
10,876,815 B1 * 12/2020 Wingfield ..... F41G 1/16
10,948,267 B2 * 3/2021 Zimmer ..... F41G 11/006
11,112,214 B2 * 9/2021 Niswander ..... F41G 1/16
11,280,587 B2 * 3/2022 Niswander ..... F41G 11/00
11,300,382 B2 * 4/2022 Holly ..... F41G 1/46
2007/0234625 A1 * 10/2007 Kidd ..... F41G 1/28 89/41.17

(Continued)

FOREIGN PATENT DOCUMENTS

KR 101188974 B1 10/2012
KR 101353092 B1 1/2014
KR 101375457 B1 3/2014

*Primary Examiner* — Michelle Clement
(74) *Attorney, Agent, or Firm* — YOU & IP, LLC; Wansik You

(57) ABSTRACT

A handgun enables the adapter plate for mounting the dot-sight to be securely and easily assembled into the slide even without using a fastening member such as a screw. The handgun equipes with the adapter plate and the slide for mounting the dot-sight with the improved assembly structure, wherein the adapter plate slides toward one side and is assembled into the slide, and then a projection lever restricts sliding of the adapter plate in an opposite direction such that the adapter plate is not unintendedly detached from the slide.

4 Claims, 10 Drawing Sheets

(56) References Cited

U.S. PATENT DOCUMENTS

| | | | | |
|---|---|---|---|---|
| 2014/0109456 | A1* | 4/2014 | Jung | F41G 1/30 42/113 |
| 2015/0268002 | A1* | 9/2015 | Jeung | F41G 1/30 42/71.02 |
| 2016/0091281 | A1 | 3/2016 | Gwillim, Jr. | |
| 2016/0334193 | A1* | 11/2016 | Zimmer | F41G 11/001 |
| 2018/0195835 | A1* | 7/2018 | Crispin | F41G 1/30 |
| 2021/0140740 | A1* | 5/2021 | Noonan | F41G 1/18 |
| 2021/0199409 | A1* | 7/2021 | Zimmer | F41G 11/003 |
| 2021/0270572 | A1* | 9/2021 | Dawson, Jr. | F41G 11/001 |
| 2021/0318099 | A1* | 10/2021 | Holly | F41G 11/002 |
| 2021/0325146 | A1* | 10/2021 | Thomele | F41G 1/065 |
| 2022/0268553 | A1* | 8/2022 | Roth | F41G 11/001 |

* cited by examiner

HANDGUN EQUIPPED WITH ADAPTER PLATE AND SLIDE FOR MOUNTING DOT-SIGHT WITH IMPROVED ASSEMBLY STRUCTURE

BACKGROUND OF THE INVENTION

Field of the Invention

The present invention relates to a handgun equipped with an adapter plate and a slide for mounting a dot-sight with an improved assembly structure, and more specifically, to a handgun equipped with both an adapter that enables various types of dot-sights (laser sights or the like) to be mounted on a rear side of the side of the handgun and a slide into which the adapter plate is assembled.

Description of the Related Art

In general, firearms such as a handgun and so on are assembled with various types of auxiliary devices as needed to assist firing. Among them, the dot-sight is widely used because it has the advantage of accurately targeting a firing target through a laser or the like.

In the case of such a dot sight, after separating a gun sight assembled in a dovetail structure at the rear of the handgun slide, the dot sight is combined with it, and then the dot-sight is fixed by assembling a screw so that it penetrates through the dot-sight and protrudes toward the dovetail.

In the meantime, the dot sights of various sizes and shapes have been developed depending on the manufacturers of the dot-sights. However, it is difficult to securely fix various types of dot sights having different sizes and shapes with only the dovetail coupling structure provided in the handgun slide.

Accordingly, a mounting plate (hereinafter referred to as an 'adapter plate') that can be replaced and installed in various ways according to the dot-sight model is additionally installed on the handgun slide. As a prior art of such an adapter plate, 'a dot-sight fixing device for a handgun' of Korean Patent Registration No. 10-1353092 (hereinafter referred to as 'Patent Literature 1') of is disclosed.

In Patent Literature 1, the dot-sight fixing device for a handgun which has a fixing projection in the lower part and combines the projection with a fixing groove on the slide of a handgun in a dovetail method, includes: a receiving groove which is formed at the center of the fixing projection in the lower part of the dot-sight fixing device; a fixing member which is placed in the receiving groove in order to be expanded or contracted toward both inner walls of the fixing groove; and an adjusting member which is combined to the lateral side of the fixing projection with a screw and selectively pressurizes or releases pressurization on the fixing member by an axial-direction movement to expand or contract the fixing member.

However, in the above Patent Literature 1, the dot-sight fixing device is configured to be closely fixed through a pair of screws assembled from both sides in a sliding assembly state in a dovetail manner to the slide of the handgun. In this way, since the dot-sight fixing device is fixed through the screw assembly and a clearance may occur in the dot-sight fixing device by means of loosening of the screw due to a vibration etc., which is a factor that reduces the aiming accuracy of the dot-sight mounted on the dot-sight fixing device.

Moreover, there are many cases where the dot-sight models have incompatible mounting structures, and for this reason, the dot-sight fixing device must also be replaced according to the dot sight model. However, in the above case, there is a hassle of loosening the screws on both sides of the slide, replacing the dot-sight fixing device, and then reassembling it by tightening the screws on both sides of the slide.

In addition, there is a problem in that it is not easy to replace the dot sight fixture or to re-tighten the loosened screws outdoors.

Therefore, there is a need to develop a handgun equipped with an adapter plate and a slide having an improved structure so that the adapter plate for dot-sight mounting can be easily assembled and separated without using screws or the like.

PATENT LITERATURE

Patent Literature 1: KR 10-1353092 B1 (Jan. 13, 2014)

Patent Literature 2: US 2016-0091281 A1 (Mar. 31, 2016)

Patent Literature 3: U.S. Pat. No. 7,287,351 B1 (Oct. 30, 2007)

Patent Literature 4: U.S. Pat. No. 8,127,485 B2 (Mar. 6, 2012)

Patent Literature 5: KR 10-1188974 B1 (Sep. 28, 2012)

Patent Literature 6: KR 10-1375457 B1 (Mar. 11, 2014)

SUMMARY OF THE INVENTION

The invention is made to solve the problem of an adapter plate and a slide for mounting a dot-sight in the relate art described above, and an object of the invention is to provide a handgun equipped with an adapter plate and a slide for mounting a dot-sight with an improved assembly structure, the handgun enabling the adapter plate for mounting the dot-sight to be securely and easily assembled into the slide even without using a fastening member such as a screw.

According to an aspect of the invention to achieve the object described above, there is provided a handgun equipped with an adapter plate and a slide for mounting a dot-sight with an improved assembly structure, including: a slide which is mounted on an upper side of the handgun and is moved by sliding in a front-rear direction; and an adapter plate which has a predetermined size and is assembled into the slide on a rear side and to which a dot-sight is detachably attached, wherein the adapter plate slides toward one side and is assembled into the slide, and then a projection lever restricts sliding of the adapter plate in an opposite direction such that the adapter plate is not unintendedly detached from the slide.

In addition, the slide includes a mounting unit that is formed at one upper end to have a flat surface having a predetermined width and length; a rail unit that is formed along a length of the mounting unit to project toward a top surface by a predetermined height; a lever that has one end which is rotatably coupled to the rail unit; a coupling pin that has a predetermined diameter and penetrates side surfaces of the rail unit and the lever; and an elastic spring that is provided between an undersurface at the other end of the lever and the rail unit and elastically supports the lever such that the other end of the lever projects upward.

In addition, the adapter plate includes a base plate that has a predetermined length and comes into surface contact with the mounting unit; and a sight that is positioned at one end of the base plate and is formed to project perpendicularly by a predetermined height, wherein an undersurface of the baseplate has a rail coupling groove having a predetermined length into which the rail unit is inserted.

In addition, the undersurface of the baseplate has a lever locking groove having a predetermined length into which the other end of the lever is inserted to fix the adapter plate.

In addition, the sight has a push member inserting groove having a predetermined size which is connected to a side of the lever locking groove, and the push member having the predetermined length is inserted through the push member inserting groove such that one end of the lever inserted into the lever locking groove is pressed, and thus the adapter plate fixed by the lever is unfixed.

BRIEF DESCRIPTION OF THE DRAWINGS

The above and other objects, features and advantages of the present invention will be more apparent from the following detailed description taken in conconfluence with the accompanying drawings, in which.

REFERENCE SIGNS LIST

Figure 1:
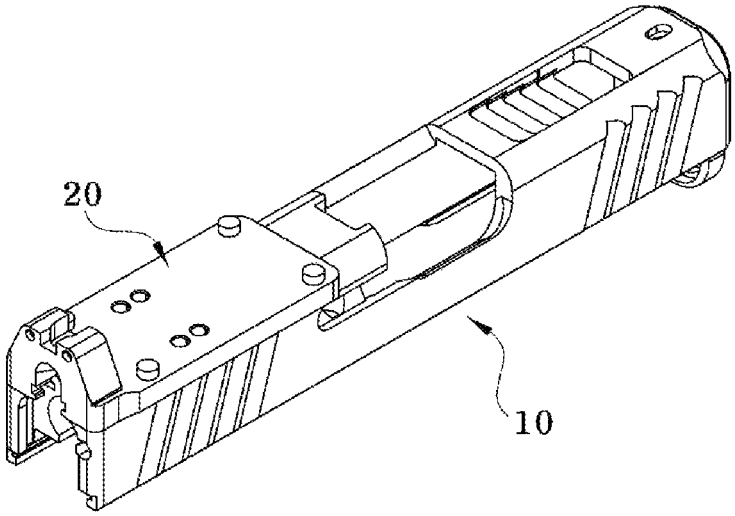
FIG. 1 is a perspective view illustrating a handgun equipped with an adapter Plate and a slide for mounting the dot-sight with an improved assembly structure according to the present invention.

10: slide
11: mounting unit
12: rail unit
12A: coupling protrusions
12B: insertion groove
12B': spring fixing groove
12C: through-hole
13: lever
13A: push guide groove
13B: pin coupling hole
13C: spring fixing groove
14: coupling pin
15: elastic spring
20, 20A, 20B, 20C, and 20D: adapter plate
21: base plate
22: sight
23: push member inserting groove

DETAILED DESCRIPTION OF THE PREFERRED EMBODIMENT

Hereinafter, the preferred embodiment of the invention will be described in detail with reference to the accompanying drawings.

The invention is made to provide a handgun equipped with an adapter plate and a slide for mounting a dot-sight with an improved assembly structure, the handgun enabling the adapter plate for mounting the dot-sight to be securely and easily assembled into a slide even without using a fastening member such as a screw. The invention has a configuration in which an adapter plate (20) slides toward one side and is assembled into a slide (10), and then a projection lever restricts sliding of the adapter plate (20) in an opposite direction such that the adapter plate (20) is not unintendedly detached from the slide (10).

Figure 2:
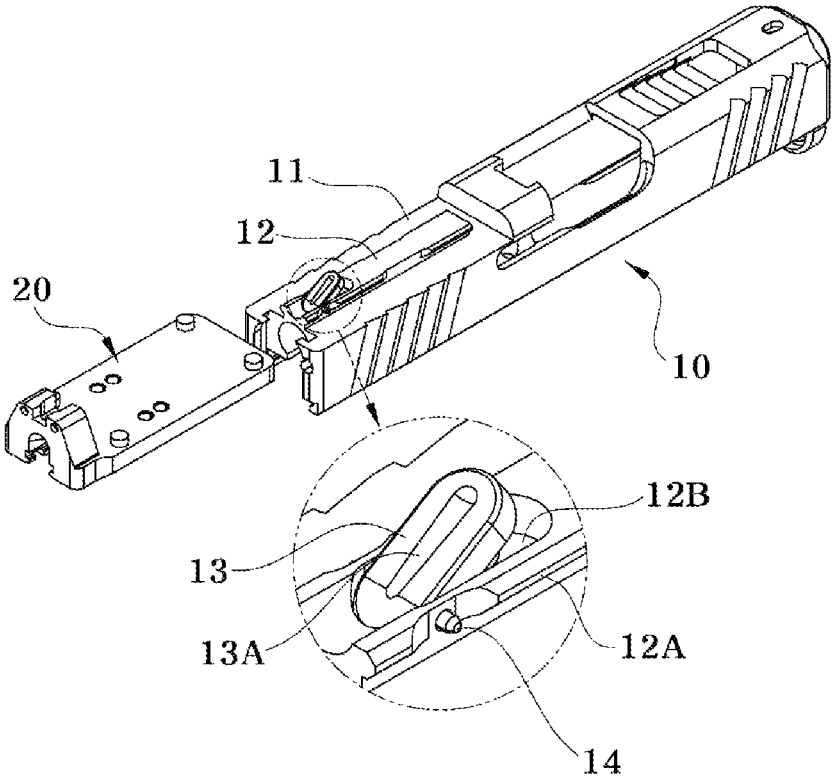
FIG. 2 is a perspective view illustrating an example in which an adapter plate and a handgun slide according to the present invention are separated.

Hereinafter, as illustrated in FIGS. 1 and 2, configurations of the slide (10) and the adapter plate (20) will be described in detail with an embodiment of the invention.

In addition, for convenience of description, a side of a muzzle is referred to as a 'front side', and an opposite side thereof is referred to as a 'rear side' in the following description.

In the configuration, the slide (10) is configured to be provided on a frame (not illustrated) of the handgun and be moved horizontally toward front and rear sides, thereby moving a bullet in a magazine (not illustrated) to a location at which the bullet can be fired and causing the handgun to come into a loaded state.

As illustrated in FIGS. 1 and 2, the slide (10) is formed to have a predetermined length based on the frame of the handgun, and an undersurface of the slide (10) has an accommodation groove having a predetermined depth into which a barrel (not illustrated), a recoil spring assembly (not illustrated), or the like is accommodated.

A mounting unit (11) having a predetermined length in a front-rear direction is formed on the rear side (rear sight position) of the slide (10), and the mounting unit (11) is formed to have a flat surface on which the adapter plate (20) to be described below can be mounted by sliding in a horizontal direction.

In addition, the mounting unit (11) has a rail unit (12) formed to project by a predetermined height and have a predetermined length in the front-rear direction, and coupling protrusions (12A) having a predetermined size are formed to project from both side surfaces of the rail unit (12). In this manner, the rail unit (12) and the coupling protrusions (12A) form a "T"-shaped cross section.

In this case, the coupling protrusion (12A) can be formed all along the length of the rail unit (12), or a plurality of coupling protrusions (12A) can be formed to have a predetermined length in a front-rear direction of the rail unit (12).

In a configuration of the rail unit (12) and the coupling protrusions (12A) described above, the adapter plate (20) is fitted and assembled into the mounting unit (11) by sliding horizontally from a rear side toward a front side in a state of being in close contact with the mounting unit (11).

Figure 3:
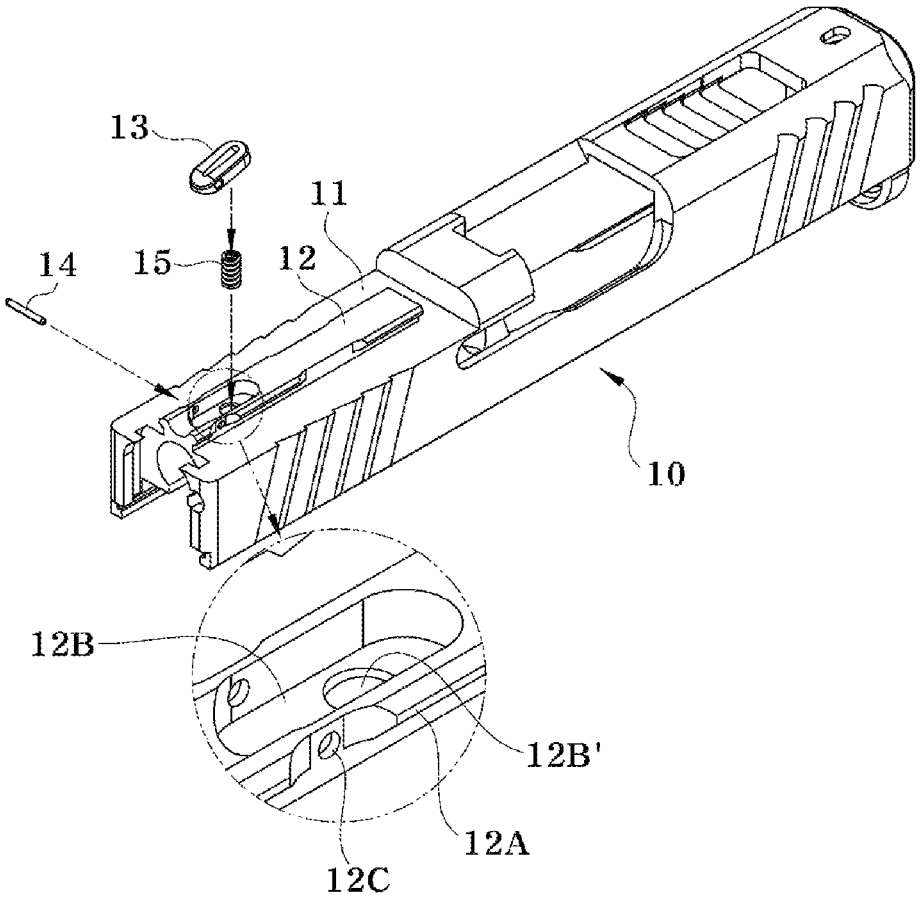
FIG. 3 is a perspective view illustrating an example of a slide according to the present invention.
Figure 4:
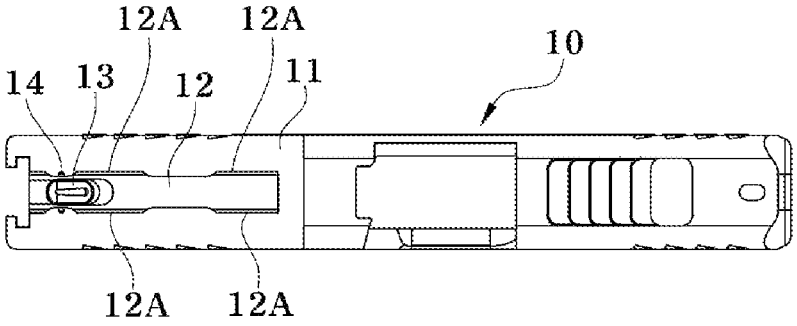
FIG. 4 is a plan view of FIG. 3.

In addition, an insertion groove (12B) having a predetermined depth is formed on a rear side of the rail unit (12), and a lever (13) having a predetermined size is rotatably provided in the insertion groove (12B). In this respect, as illustrated in FIG. 3, the rail unit (12) has a through-hole (12C) having a predetermined diameter which penetrates both side surfaces of the insertion groove (12B), and a coupling pin (14) having a predetermined length is inserted to penetrate the through-hole (12C) as illustrated in FIG. 4 such that the lever (13) is fixed to have one end that is rotatable by the coupling pin (14) inside the insertion groove (12B).

A bottom surface on one side of the insertion groove (12B) have a spring fixing groove (12B') having a predetermined depth, and one end (lower end) of an elastic spring (15) is inserted into the spring fixing groove (12B') by a predetermined depth and has a fixed position.

Figure 5:
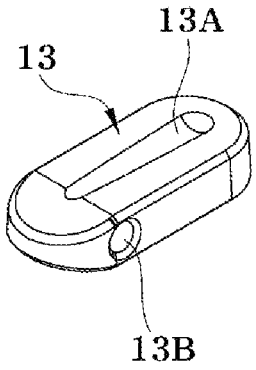
FIG. 5 and FIG. 6 are perspective views illustrating an example of a lever according to the present invention.

On the other hand, as illustrated in FIG. 5, the lever (13) can have a push guide groove (13A) having a predetermined length in the front-rear direction at a top surface of the lever. Hence, one end of a push member (not illustrated) is accurately guided to a location by the push guide groove (13A) such that the adapter plate (20) fixed (locked) by the lever (13) can be unfixed (unlocked).

Figure 6:
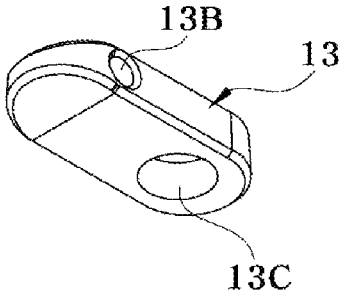
Figure 7:
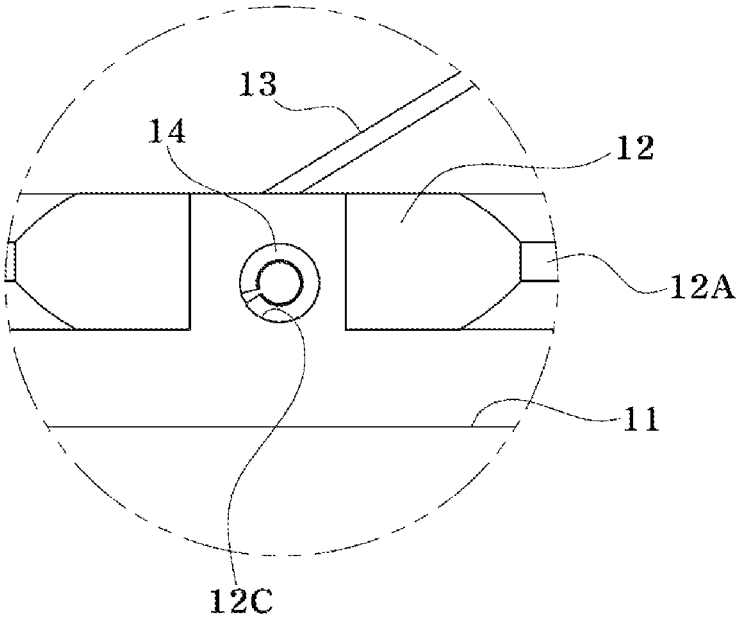
FIG. 7 is a view illustrating an example in which a lever is coupled by a hinge pin according to the present invention.

In addition, a pin coupling hole (13B) having a predetermined diameter is formed to penetrate both side surfaces at one end of the lever (13), and the coupling pin (14) is inserted into the pin coupling hole (13B). An undersurface of the lever (13) has a spring fixing groove (13C) having a predetermined diameter as illustrated in FIG. 6, and the other end (upper end) of the elastic spring (15) is inserted into the spring fixing groove (13C). In this manner, the elastic spring (15) is stably fixed at a location between the insertion groove (12B) and the lever (13) to elastically support a free end (one end which is not fixed with the coupling pin (14)) of the lever (13).

The adapter plate (20) is configured to be mounted on the mounting unit (11) of the slide (10) and used to mount an aiming-assist sight such as a dot-sight.

Figure 8:
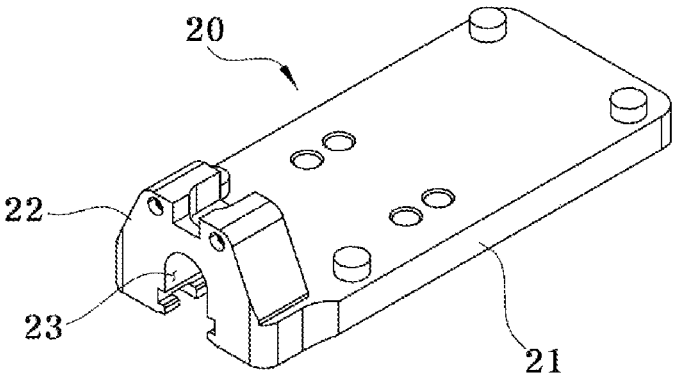
FIG. 8 and FIG. 9 are perspective views illustrating an example of an adapter plate according to the present invention.

As illustrated in FIG. 8, the adapter plate (20) includes a base plate (21) that has a predetermined length and comes into surface contact with the mounting unit (11) of the slide (10) and a sight (22) that is positioned at one end of the base plate (21) and is formed to project perpendicularly by a predetermined height.

Figure 9:
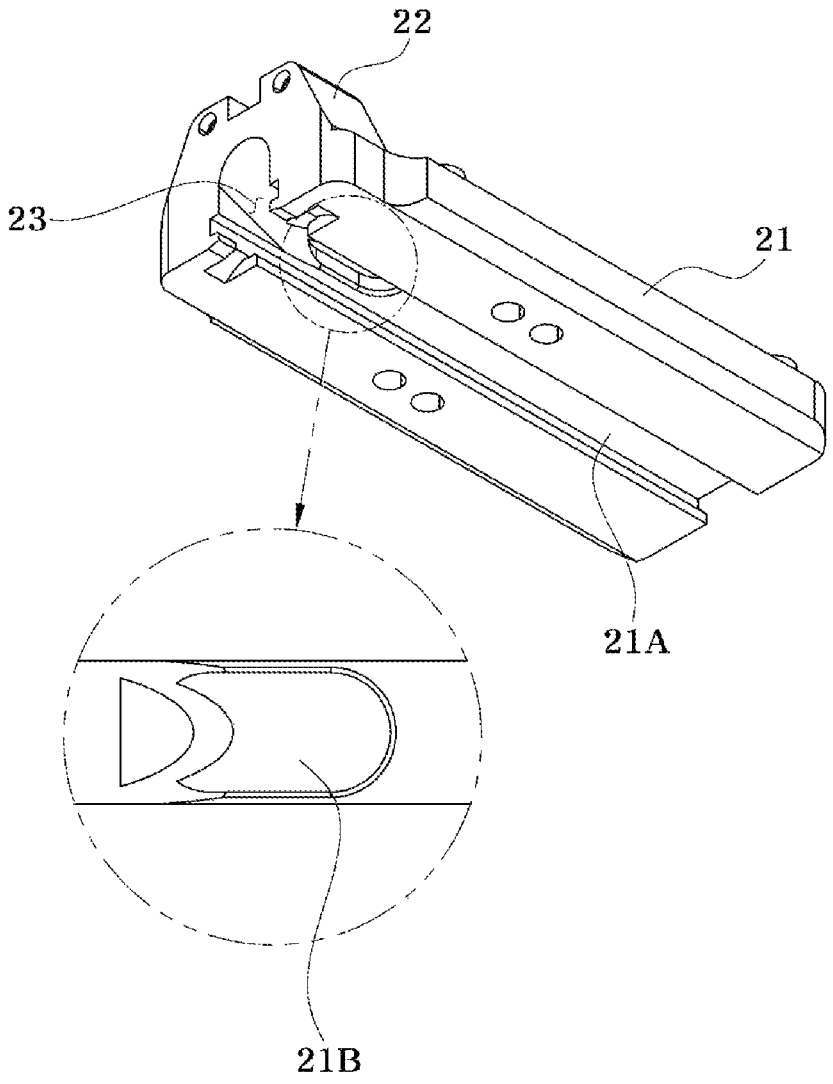

As illustrated in FIG. 9, an undersurface of the base plate (21) has a rail coupling groove (21A) which has a predetermined depth and is formed along a length thereof corresponding to a position of the rail unit (12) of the slide (10), and the rail coupling groove (21A) has a lever locking groove (21B) having a predetermined depth corresponding to a position of the lever (13) in a state where the adapter plate (20) is completely assembled into the mounting unit (11).

In addition, the rail coupling groove (21A) is formed to have a "T"-shaped cross section corresponding to the shape of coupling protrusion (12A) of the rail unit (12).

Figure 10:
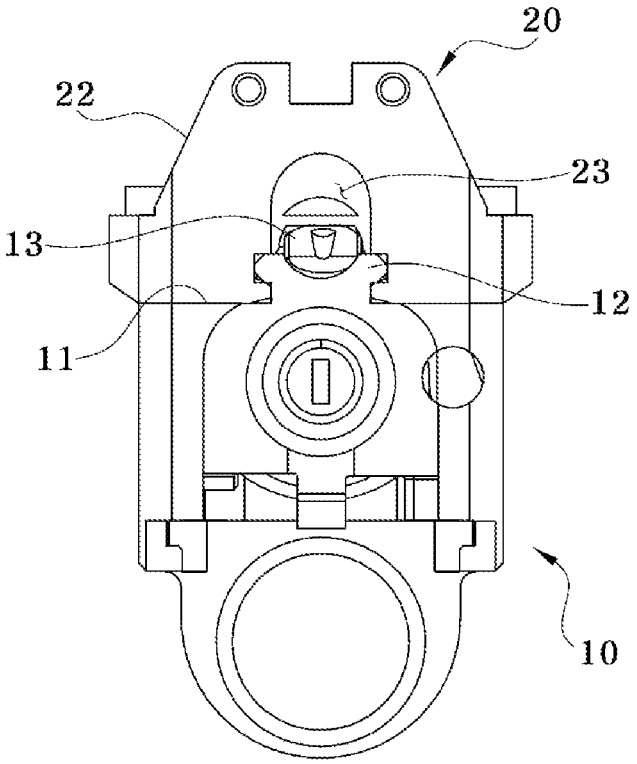
FIG. 10 is a side view illustrating an example in which an adapter plate is assembled to a slide according to the present invention.

Additionally, the sight (22) fulfils a rear sight function in a state where a separate dot-sight is not mounted, and therefore a groove (not assigned with Reference sign) having a predetermined depth for an aimed shot may be formed at an upper central side of the sight (22) as illustrated in FIGS. 8 and 10.

A push member inserting groove (23) that communicates with the rail coupling groove (21A) and the lever locking groove (21B) is formed on a side of the sight (22), and the lever (13) positioned inside on the rear side of the adapter plate (20) is exposed through the push member inserting groove (23) as illustrated in FIG. 10.

Figure 11:
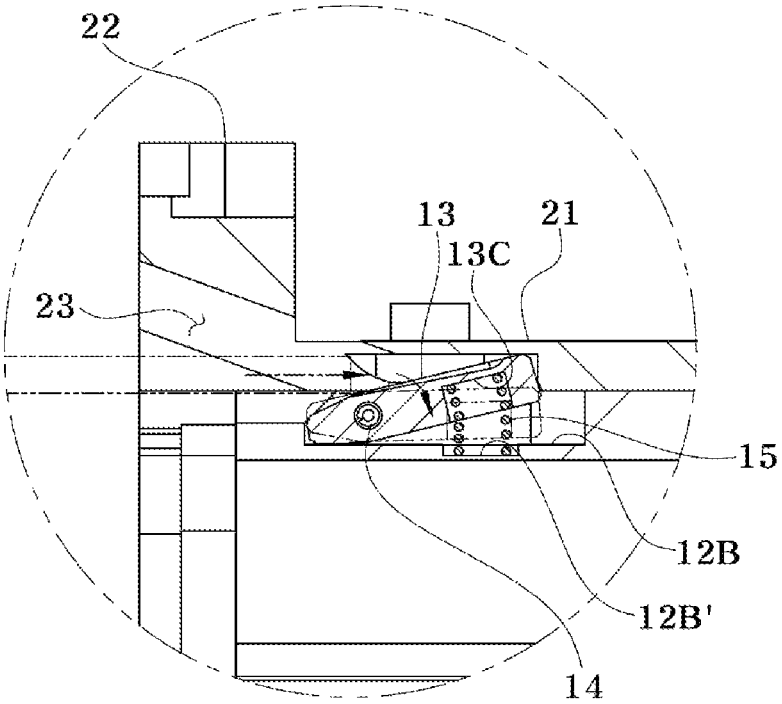
FIG. 11 is a cross-sectional view illustrating an example in which an adapter plate is assembled to a slide according to the present invention.

In this respect, as illustrated in FIG. 11, the push member (not assigned with Reference sign) having a predetermined length can be inserted between the adapter plate (20) and the mounting unit (11) of the slide (10) through the push member inserting groove (23). As a result, the push member can press the lever (13) positioned inside such that the adapter plate (20) is unlocked, and thereby the adapter plate (20) can be detached from the slide (10).

Figure 12:
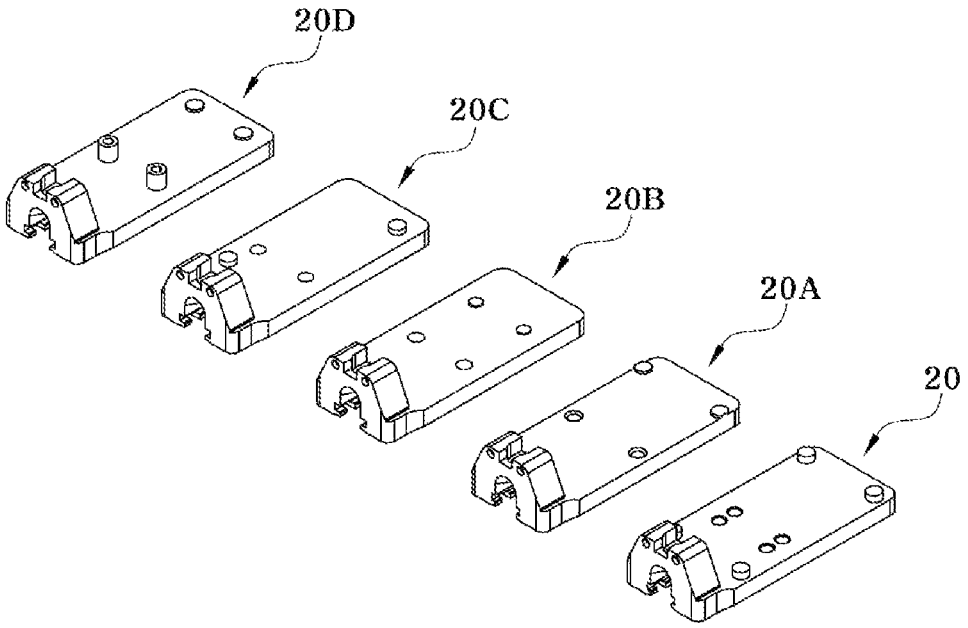
FIG. 12 is a view illustrating another embodiment of an adapter plate according to the present invention.

On the other hand, the base plate (21) of the adapter plate (20) can have position fixing holes or screw coupling holes formed at various positions depending on a dot-sight model. For example, as illustrated in FIG. 12, the base plate (21) of the adapter plate (20) can have four coupling holes at predetermined intervals and two position fixing holes at a predetermined interval from the coupling holes, the position fixing holes formed to project.

Alternatively, adapter plates (20A and 20B) that have two coupling holes and two position fixing holes formed at predetermined intervals can be realized. Alternatively, an adapter plate (20C) that has two coupling holes and one position fixing hole can be realized. Alternatively, an adapter plate (20D) that has two position fixing holes and two coupling holes, the position fixing holes being formed to project by a predetermined height, can be realized.

Although not described, the number or position of the coupling holes and the position fixing holes can be variously modified depending on various commercial models of the dot-sight.

AS described above, according to the invention, the adapter plate slides to be assembled into the slide of the handgun, and thereby the adapter plate is fixed by the lever to have a fixed position. In this manner, the adapter plate can be easily and quickly assembled even without using a fastening member such as a screw.

In addition, the push member is inserted into the push member inserting groove formed at the rear side of the adapter plate, and thereby the lever between the slide and the adapter plate is pressed to unlock (unfix) the adapter plate. In this manner, the adapter plate can be easily replaced according to various types of dot-sights.

According to the invention, the following advantage is obtained. The adapter plate slides to be assembled into the slide of the handgun, and thereby the adapter plate is fixed by the lever to have a fixed position. In this manner, the adapter plate can be easily and quickly assembled even without using a fastening member such as a screw.

In addition, the invention has another advantage in that the push member is inserted into the push member inserting groove formed at a rear side of the adapter plate, and thereby the lever between the slide and the adapter plate is pressed to unlock (unfix) the adapter plate. In this manner, the adapter plate can be easily replaced according to various types of dot-sights.

In the above, for the convenience of explanation, the drawings illustrating the preferred embodiments and the configurations shown in the drawings have been described with reference numerals and names. However, as an embodiment according to the present invention, the scope of the invention should not be interpreted as it is limited to the shapes shown in the drawings and the names given. While the present invention has been described with respect to the specific embodiments, it will be apparent to those skilled in the art that various changes and modifications may be made without departing from the spirit and scope of the invention as defined in the following claims.

What is claimed is:

1. A handgun equipped with an adapter plate and a slide for mounting a dot-sight with an improved assembly structure, comprising:

a slide which is mounted on an upper side of the handgun and is moved by sliding in a front-rear direction; and an adapter plate which has a predetermined size and is assembled into the slide on a rear side and to which a dot-sight is detachably attached, wherein the adapter plate slides toward one side and is assembled into the slide, and then a projection lever restricts sliding of the adapter plate in an opposite direction such that the adapter plate is not unintendedly detached from the slide, wherein the slide includes:

a mounting unit that is formed at one upper end to have a flat surface having a predetermined width and length;

a rail unit that is formed along a length of the mounting unit to project toward a top surface by a predetermined height;

a lever that has one end which is rotatably coupled to the rail unit;

a coupling pin that has a predetermined diameter and penetrates side surfaces of the rail unit and the lever; and an elastic spring that is provided between an undersurface at the other end of the lever and the rail unit and elastically supports the lever such that the other end of the lever projects upward.

2. The handgun equipped with an adapter plate and a slide for mounting a dot-sight with an improved assembly structure according to claim 1, wherein the adapter plate includes:

a base plate that has a predetermined length and comes into surface contact with the mounting unit; and a sight that is positioned at one end of the base plate and is formed to project perpendicularly by a predetermined height, wherein an undersurface of the baseplate has a rail coupling groove having a predetermined length into which the rail unit is inserted.

3. The handgun equipped with an adapter plate and a slide for mounting a dot-sight with an improved assembly structure according to claim 2, wherein the undersurface of the baseplate has a lever locking groove having a predetermined length into which the other end of the lever is inserted to fix the adapter plate.

4. The handgun equipped with an adapter plate and a slide for mounting a dot-sight with an improved assembly structure according to claim 3, wherein the sight has a push member inserting groove having a predetermined size which is connected to a side of the lever locking groove, and wherein the push member having the predetermined length is inserted through the push member inserting groove such that one end of the lever inserted into the lever locking groove is pressed, and thus the adapter plate fixed by the lever is unfixed.

* * * * *